United States Patent [19]

Lind et al.

[11] 4,066,453

[45] Jan. 3, 1978

[54] PROCESS FOR THE PREPARATION OF PRINTING FORMS

[75] Inventors: Erwin Lind, Auringen; Franz Freimuth, Wiesbaden-Biebrich, both of Germany

[73] Assignee: Hoechst Aktiengesellschaft, Germany

[21] Appl. No.: 692,154

[22] Filed: June 2, 1976

Related U.S. Application Data

[63] Continuation of Ser. No. 466,069, May 1, 1974, abandoned.

[30] Foreign Application Priority Data

May 2, 1973 Germany ..... 2322047

[51] Int. Cl.[2] ..... G03G 13/26

[52] U.S. Cl. ..... 96/1 R; 96/1 LY; 96/1 SD; 101/401.1; 427/16; 427/19

[58] Field of Search ..... 96/1 R, 1 LY, 1 SD; 101/401.1; 427/16, 19

[56] References Cited

U.S. PATENT DOCUMENTS

| | | | |
|---|---|---|---|
| 3,287,114 | 11/1966 | Hoegl | 96/1.5 |
| 3,305,359 | 2/1967 | Delmont | 96/1.5 |
| 3,406,061 | 10/1968 | Metcalfe et al. | 96/1.5 |
| 3,615,385 | 10/1971 | Lind | 96/1 R |
| 3,745,002 | 7/1973 | Honjo et al. | 96/1 R |
| 3,748,127 | 7/1973 | Amidon et al. | 252/62.1 L |
| 3,839,028 | 10/1974 | Tamai et al. | 96/1 R |
| 3,954,467 | 5/1976 | Takimoto et al. | 427/16 X |

FOREIGN PATENT DOCUMENTS

| | | | |
|---|---|---|---|
| 1,182,174 | 2/1970 | United Kingdom | 96/1.5 |

*Primary Examiner*—Roland E. Martin, Jr.
*Attorney, Agent, or Firm*—James E. Bryan

[57] ABSTRACT

This invention relates to an improvement in the process for the preparation of printing forms or metallic etchings from electrophotographic or electrographic reproduction materials composed of a support with a photoconductive or high-ohmic layer thereon, by charging and image-wise exposure, or by image-wise charging, development of the electrostatic image with a finely-divided toner, fixing, and removal of the layer in the image-free areas by means of a decoating solution, the improvement comprising developing the electrostatic image with a developer which reacts at least superficially with the image areas at room temperature, thereby simultaneously effecting development and resistance to the decoating solution, or developing the electrostatic image with a developer which reacts with the decoating solution and thereby deactivates it in the image areas.

24 Claims, No Drawings

PROCESS FOR THE PREPARATION OF PRINTING FORMS

This is a continuation, of application Ser. No. 466,069, filed May 1, 1974, now abandoned.

This invention relates to the preparation of printing forms or metallic etchings from electrophotographic or electrographic reproduction material composed of a suitable support with a photoconductive or high-ohmic layer thereon, by charging and image-wise exposure of the material, or by image-wise charging of the material, followed by development of the electrostatic image with a finely-divided toner, fixing, removal of the layer in the image-free areas by means of a decoating solution, and, optionally, etching of the bared areas of the support.

It is known to use electrophotographic reproduction materials for printing purposes. German Offenlegungsschrift No. 1,522,497, for example, describes a process for the preparation of printing forms, according to which a copying material composed of a support and an electrophotographic layer comprising a polymerizable organic photoconductor is electrostatically charged, image-wise exposed, developed, and the developed image is finally heated to 50° to 300° C. The developer used contains or consists of a substance which forms radicals under the influence of heat, so that polymerization of the photoconductor layer occurs in the developed image areas during heating. In this manner, the solubility of the photoconductor layer is reduced and a printing form may be prepared by dissolving away the image-free areas.

Further, it is known from German Offenlegungsschrift No. 1,572,312, to initiate polymerization by replacing the radical-forming substance disclosed in the aforementioned publication by a substance which effects ionic polymerization under the influence of heat.

Further, it is known from French Pat. No. 1,299,869 to prepare a printing plate by electrophotographic means from a material in which the zinc oxide used as the photoconductor is finely distributed in a cross-linkable binder within the layer, development of the latent electrostatic image being effected by applying a finely divided solid substance which catalyzes the cross-linking reaction of the binder, so that the image areas become more difficultly soluble, or even insoluble, in certain solvents when the developer is burned in.

German Pat. No. 974,162, describes a process for the preparation of lithographic printing plates from coated papers by electrophotographic means, wherein the latent electrostatic image is developed with a powder which accepts greasy printing ink, and the non-printing areas of the developed printing plate are rendered hydrophilic.

Further, it is known to prepare printing plates by electrophotographic means with the aid of a dry developer which contains a resin comprising vinyl radicals or chlorine radicals, the photoconductive layer of the material being impregnated with a zinc salt. After development, the material is heated so that the zinc salt and the resin react with each other to form a black substance (U.S. Pat. No. 2,735,785).

The described processes have the disadvantage that, after electrostatic charging, exposure and development, the copying materials to be converted into printing plates must be heated to temperatures up to 300° C. in a separate process step, or that pressure or solvents must be applied for fixation, which processes not only require time, but also a substantial expenditure on equipment.

Thus, it is the object of the present invention to provide a process for the preparation of printing forms which may be performed at a relatively low temperature, if possible at room temperature, and which requires no additional fixing step.

A dry imaging process already has been suggested for the electrophotographic field (German Auslegeschrift No. 1,057,449) wherein development and fixing are substantially performed by a chemical reaction between a component of the toner and a component present in the photoconductor layer, but this process has not been used in practice. Moreover, the process cannot be used for the preparation of printing forms because the proposed reactions are dye-stuff reactions which do not cause a differentiation between the solubility of the image areas and the solubility of the non-image areas during the subsequent decoating step. Further, it is also suggested in this patent to improve the process by the application of heat for fixation.

It was found that the object of facilitating the method of operation in a process for the preparation of printing forms or metallic etchings from electrophotographic or electrographic reproduction materials composed of a support with a photoconductive or high-ohmic layer thereon, by charging and image-wise exposure, or by image-wise charging of the material, development of the electrostatic image with a finely divided toner, fixing, and removal of the layer in the imagefree areas by means of a decoating solution, optionally followed by etching of the bared surface of the support, is surprisingly achieved by using a developer which reacts at least superficially with the image areas at room temperature, thus simultaneously effecting development and resistance to the decoating solution, or a developer which reacts with the decoating agent and thus deactivates it in the image areas. The reaction in the image areas results from using a developer which reacts at least partially with the resin binder contained in the photoconductive or high-ohmic layer, to form complex compounds, chelate compounds, or salts, or by using a developer which reacts at least partially with the photoconductor contained in the layer to form a sparingly soluble donor-acceptor complex. Alternatively, the reaction may be effected by using a developer which reacts at least partially with a component of the decoating solution to form a salt, thus preventing the decoating solution from acting upon the reproduction layer in the areas covered by the developer.

Consequently, the developer material to be used depends on the composition of the photoconductive or high-ohmic layer and/or on the decoating solution employed.

It is achieved by the process of the present invention that the additional fixing step performed, for example, by heating or burningin within a substantially constant and controllable temperature range, using expensive apparatus, can be completely omitted, providing instead a process for the preparation of printing plates which can be easily and economically performed, using even such supporting materials as paper and metallized plastic films. If metallized films are used, for example, decoating and etching of the metal layer in the non-image areas produces transparent images whose image areas are distinguished by a very high optical density. The images produced on the film bases are true to scale, because fixing of the toner image by heat action — which always involves the risk of a possible change in dimensions — is not necessary. Altogether, the inventive process provides a considerable saving in time and apparatus, which is of decisive importance with a view to the automation of the entire process.

By the process of the present invention, printing forms for planographic printing, gravure printing, letterpress printing, and screen printing, as well as printed circuits, may be produced by electrophotographic or electrographic methods.

The electrophotographic printing form used as the starting material for the process of the invention is known in principle. The use of photoconductive organic substances in electrophotographic layers and their conversion into printing forms are known, e.g., from the publications mentioned above for defining the present state of technology. Photoconductors containing one or more dialkyl amino groups may be used with particular advantage in the present invention.

Particular mention is to be made of heterocyclic compounds, such as the oxadiazole derivatives which are known from German Pat. No. 1,058,836, especially the 2,5-bis-(4'-diethylaminophenyl)oxadiazole-1,3,4. Other suitable photoconductors are, for example, triphenylamine derivatives, highly condensed aromatic compounds, such as anthracene, benzo-condensed heterocyclic compounds, and pyrazoline or imidazole derivatives. The triazole and oxazole derivatives disclosed in German Pat. Nos. 1,060,260, and 1,120,875, also may be used. Further, vinyl-aromatic polymers, such as polyvinyl anthracene, polyacenaphthylene, and poly-N-vinylcarbazole, and the copolymers of these compounds, are also suitable, provided they produce a differentiation in the solubility characteristics, if necessary in combination with a resin binder. Other suitable compounds are polycondensates of aromatic amines and aldehydes, such as those known from German Auslegeschrift No. 1,197,325. In addition to the compounds just mentioned, which preponderantly are of p-conductive nature, n-conductive compounds may also be used. These so-called electron acceptors are known, for example, from German Pat. No. 1,127,218.

As regards film-forming characteristics and adhesion, both natural and synthetic resins are suitable as resin binders. In addition to their film-forming and electrical characteristics and their adhesion to the support, the solubility characteristics of the resins are of particular importance in their selection. Resin binders which are soluble in aqueous or alcoholic solvent systems, to which, if desired, an acid or an alkaline substance may be added, are particularly suitable for practical purposes. For physiological and safety reasons, readily flammable aromatic or aliphatic solvents are ruled out. Therefore, suitable resin binders are high molecular weight substances containing groups which render them alkali-soluble, such as acid anhydride groups, carboxyl groups, phenol groups, sulfonic acid groups, sulfonamide or sulfonimide groups. Resin binders having high acid numbers are preferred because they are particularly easily soluble in alkaline-aqueous-alcoholic solvent systems. Copolymers containing anhydride groups may be used with particular advantage because, due to the absence of free acid groups, the conductivity of the electrophotographic layer in the dark is low, in spite of its good solubility in alkaline solutions.

Copolymers of styrene and maleic anhydride, such as those known by the name of "Lytron" (marketed by Monsanto Chemical Company, St. Louis, Mo., USA), and phenol resins, such as those known by the name of "Alnovol" (marketed by Chemische Werke Albert, Wiesbaden-Biebrich, Germany) have proved to be particularly suitable.

Further, the copying layer of the electrophotographic printing form used as the starting material may contain known senstizers. Only small quantities of sensitizer are added to the copying layer, i.e. about 0.001% to about 1% by weight, calculated on the weight of the photoconductor component. Suitable sensitizers, most of them dyestuffs, are known, for example, from Belgian Pat. no. 558,078.

If electrographic layers are used, the same resin binders as described in connection with the electrophotographic layers may be employed. The layers must meet the same requirements as the photoconductive layers, but the photoconductor component is omitted.

Any of the known materials suitable for this purpose, e.g. aluminum, zinc, magnesium, chromium, or copper plates, may be used as the support of the electrophotographic or electrographic printing plate used as the starting material, and their surfaces may be pretreated, if desired. Cellulose products, such as cellulose hydrate, cellulose acetate, or cellulose butyrate films, or paper that has been superficially hydrophilized and made electrically conductive, as also plastic films and compound materials composed of paper or plastic film and metal layers, also may be used. Supports composed of layers of different metals also are suitable.

For the preparation of metallic etchings, metallized plastic materials in the form of films or plates are used as supports, the metal layer being applied by vapor deposition, lamination, or by chemical or galvanic metal deposition.

Suitable developers are solid inorganic or organic compounds which are capable of reacting at room temperature with a component of the layer, to form either a complex compound, a chelate compound, or a salt, which are resistant to the decoating solution, or, alternatively, a donor-acceptor complex resistant to the decoating solution. The developer substances must have similar solubility characteristics to those of the copying layer. They must be capable of being superficially dissolved at the beginning of the decoating process for the reaction to proceed.

In the case of the particularly preferred copolymer of styrene and maleic anhydride, the salts of multivalent metals, such as chromium, manganese, iron or copper, or the salts of the metals of the IInd, IIIrd, or IVth main groups of the Periodic System, e.g. magnesium, aluminum, or tin, have proved to be particularly advantageous. On the other hand, if the above-mentioned phenol resins are used, excellent results are obtained when using either developer substances of the triphenyl methane dyestuff type, e.g. "Crystal Violet" (Schultz' Farbstofftabellen, Vol. I, 7th Ed. 1931, No. 785, page 329) or aromatic diazonium salts. Developer substances which at least partially react with the photoconductor component are compounds such as tetraphenyl cyclopentadienone, benzoquinone, dicyanochlorobenzoquinone, benzo-anthraquinone, tetrachloroquinone, dibromo-succinic acid, tetrachlorophthalic anhydride, dinitronaphthalic anhydride, tetranitronaphthalene, and the like. These compounds produce excellent results, especially when used with oxadiazoles and oxazoles as the photoconductive substances.

Suitable developer substances are also those compounds which react at least partially with a component of the decoating solution, with salt formation, thus rendering the decoating solution ineffective in the areas covered by the developer. The chemical characteristics of the developer depend on the decoating method. If an aqueous or alcoholic-alkaline medium is used for decoating, inorganic or organic acids are used as developers. Boric acid and toluene sulfonic acid are particularly suitable for this purpose. On the other hand, if decoating is effected in an acid environment, the developer substances must have acid-binding characteristics. If an aqueous phosphoric acid solution is used as the decoating solution, calcium oxide has proved to be particularly suitable as the developer substance.

The above-mentioned substances may be used either in a dry development process, or they may be applied as developer dispersions in a liquid developing process. A liquid developing process is preferred, using a developer composed of a high-ohmic liquid phase with a finely-divided solid phase dispersed therein. Liquid development is preferred because the developing proces is clean and free from dust and the copies produced are distinguished by a very good photographic dissolution.

The liquid developer is composed of a dispersing medium, the reactive component, and additives which promote the dispersion of the components and influence their electrical charge.

The preparation and use of suitable additives are described in German Auslegeschrift No. 1,047,616.

The developer dispersions may further contain additives which do not participate in the reaction, but serve to increase the hydrophobic properties or improve the coverage of the image areas. Bitumen and wax or resin-like substances in finely-dispersed form have proved to be particularly suitable for this purpose. Suitable dispersing media are those liquids which do not dissolve the solid phase, e.g. halogenated hydrocarbons, and, above all, liquid aliphatic hydrocarbons, for example isoparaffins with a boiling range between 185° and 210° C. The polarity of the charge of the dispersed phase depends upn the properties of the dispersed substance itself as well as upon the selected dispersion medium.

The developer may be applied in known manner. In the case of a liquid developer, the developer may be applied by immersion or by roller application, the latter method being preferred because it results in better uniformity.

After development of the latent electrostatic image, the developer substance adheres to the copying layer in the form of the image. Application of the decoating solution follows.

The decoating solution is distributed over the layer, for example by wiping with a cotton pad. Alternatively, the plates may be immersed in the decoating solution. As a preferred method, the decoating solution is sprayed upon the layer. Suitably constructed apparatuses also may be used for decoating, e.g., applicator roll systems. In this manner, the differentiation between hydrophilic and oleophilic areas necessary for offset printing is produced, the image areas representing the oleophilic portions and the bared surface of the support representing the hydrophilic portions of the printing plate.

The composition of suitable decoating solutions is known, for example, from German Pat. No. 1,117,391. Decoating solutions which have proved to be particularly suitable for the inventive process are mixtures of alcohols containing sodium metasilicate or ethanolamine as the alkaline component. A 5% by weight aqueous solution of phosphoric acid has proved to be particularly advantageous as an acid decoating solution.

After treatment with the decoating solution, the printing plate is advantageously rinsed with water; if desired, its hydrophobic properties may be increased by wiping it over with dilute phosphoric acid solution. After inking with greasy ink, printing may be performed in known manner in a planographic printing machine (offset printing).

Alternatively, printing forms for letterpress or, if desired, for gravure printing may be produced by the subsequent dissolution of the bared supporting material. Dissolution may be performed in known one-bite or multi-stage etching machines used for this purpose. If a multi-metal material is used as the support, etching is performed by conventional photoengraving methods. The printing plates obtained by the present process are capable of very long runs.

By the process of the present invention, printing forms and printed circuits may be produced; further, it may be used in the X-ray and microfilm field.

The invention will be further illustrated by reference to the following examples:

EXAMPLE 1

A solution containing 10 g of 2,5-bis-(4'-diethylaminophenyl)1,3,4-oxadiazole, 10 g of a styrene/maleic anhydride copolymer with a softening point of 210° C, and 20 mg of "Rhodamine FB" in 300 ml of glycol monomethyl ether is applied to a superficially roughened, about 100μ thick, aluminum foil. The photoconductive layer produced after evaporation of the solvent is charged in the dark to a negative potential of about 400 volts by means of a corona. The charged plate is exposed in a camera and then developed, using a toner liquid prepared by finely dispersing 3.0 g of magnesium sulfate in a solution of 7.5 g of pentaerythritol resin ester in 1,200 ml of an isoparaffin having a boiling range between 185° and 210° C. After removal of excess toner liquid, the plate is immersed for 60 seconds in a solution containing 35 g of sodium metasilicate hydrate in a mixture of 140 ml of glycerol, 550 ml of ethylene glycol, and 140 ml of ethanol. The plate is then rinsed down with a strong water jet, whereby the areas of the photoconductive layer not covered by the toner are removed.

The resulting plate may be used for printing in the conventional manner in a printing machine. Very long runs are obtainable.

EXAMPLE 2

A solution containing 10 g of 2-vinyl-4-(2'-chlorophenyl)-5-(4''-diethyl-aminophenyl)-oxazole, 10 g of a styrene/maleic anhydride copolymer with a softening point of 210° C, and 20 mg of "Rhodamine FB" in a mixture of 235 ml of glycol monomethyl ether and 65 ml of butyl acetate is applied to an about 100μ thick, superficially roughened aluminum foil. After evaporation of the solvent, the resulting photoconductor layer is charged by means of a corona to a positive potential of about 400 volts and then exposed in a camera. A fine dispersion of 3 g of potassium aluminum sulfate in a solution of 7.5 g of pentaerythritol resin ester in 1,200 ml of an isoparaffin with a boiling range between 185° and 210° C is used for development.

The printing plate thus produced in converted into a printing form by immersing it for 1 minute in a solution of 35 g of sodium silicate hydrate in a mixture of 140 ml of glycerol, 500 ml of ethylene glycol, and 140 ml of ethanol, and then rinsing it with a water jet, with gentle brushing.

EXAMPLE 3

A photoconductor layer is produced on a roughened aluminum layer as described in Example 2. The layer is charged to a negative potential of approximately 400 volts and exposed under a negative transparency in a re-enlargement apparatus. At stop 8 and an enlargement ratio of 1 : 5, the exposure time is 20 seconds when a 100 watt incandescent lamp is used. Development and conversion into a printing form are performed as described in Example 2. A positive image is obtained from the negative transparency.

EXAMPLE 4

A superficially roughened aluminum foil of about 100μ thickness is coated with a solution containing 10 g of 2-(4'-diethylaminophenyl)-6-methyl-benzthiazole-(N,N-dimethylsulfonamide) (prepared as described in German Pat. No. 1,137,625), 10 g of a phenolformaldehyde resin with a softening range of 108° – 118° C, 5 g of a low viscosity chlorinated rubber, and 100 mg of "Rhodamine FB" in 100 ml of butanone. The electrophotographic printing plate thus obtained is charged in the dark to a negative potential of 200 volts by means of a corona and is then exposed in a vacuum printing frame under and in contact with a positive transparency. Using an incandescent lamp of 100 watts at a distance of 65 cm, the exposure time is 7 seconds. The latent image thus produced is developed with a developer liquid prepared by finely dispersing 0.3 g of 4-diazo-2,5-dinbutoxy-phenyl-morpholine-fluoborate in a solution of 0.4 g of a pentaerythritol resin ester in 1,000 ml of an isoparaffin with a boiling range between 185° and 210° C. The developed plate is immersed for 15 seconds in a solution of 22 g of sodium metasilicate hydrate in a mixture of 150 ml of ethylene glycol, 85 ml of glycerol, 170 ml of methanol, and 75 ml of water, and then rinsed with a strong water jet with gentle brushing. The printing plate thus produced is capable of printing long runs.

EXAMPLE 5

A solution of 15 g of a condensation product of N-ethylaniline and formaldehyde, 0.41 g of dibromo-succinic acid, and 0.15 g of "Rhodamine FB" in a mixture of 40 ml of toluene, 20 ml of trichloroethylene, and 25 ml of methanol is coated upon a mechanically roughened aluminum foil. After evaporation of the solvents, a photoconductor layer is produced which is charged in the dark to a negative potential of 350 volts by means of a corona. The charged foil is then exposed for approximately 2 minutes in a camera and developed with a toner liquid which protects the image areas from the effect of the decoating solution by undergoing a reaction with the latter. The toner used is a mixture of 5 g of finely ground calcium oxide and 100 g of iron powder of a grain size between 75 and 150μ. A 5% phosphoric acid solution containing 10% of ethanol is used for removal of the photoconductor layer. The toner-covered plate is bathed in this solution for about 30 seconds and then rinsed with water.

EXAMPLE 6

A bimetal plate consisting of layers of brass and chromium is coated with a solution of 10 g of 2-vinyl-4-(2'-chlorophenyl)-5-(4'-diethylaminophenyl)-oxazole, 10 g of a styrene/maleic anhydride copolymer with a softening point of 210° C, and 20 mg of "Rhodamine FB" in a mixture of 235 ml of glycol monomethyl ether and 65 ml of butyl acetate. For the preparation of the printing form, the coated plate is charged to a negative potential of about 350 volts, exposed in contact with a negative for 3 seconds to the light of a 100 watt incandescent lamp at a distance of 65 cm, and developed with a toner liquid. The toner liquid is prepared by dispersing 3 g of tetraphenyl cyclopentadienone, 1.2 g of a high-vacuum bitumen, and 6.0 g of a pentaerythritol ester resin in 1,000 ml of an isoparaffin having a boiling range between 185° and 210° C. After removal of excess toner liquid, the photoconductor layer is removed in the areas not covered by the toner. The sodium metasilicate hydrate solution described in Example 1 is used for this purpose. In the areas of the plate freed from the photoconductor layer, the chromium layer is then removed by etching, using a commercial chromium etching solution. A printing form is thus obtained from which very long runs (more than 100,000 copies) may be printed.

EXAMPLE 7

A photoconductor layer is applied as described in Example 1 to a 350μ thick aluminum plate with a 1μ thick chrome-plated layer thereon. The plate is charged to a negative potential of 350 volts, exposed, and developed with a toner liquid prepared by finely dispersing 0.5 g of potassium dichromate in a solution of 1.0 g of pentaerythritol resin ester in 1,000 ml of an isoparaffin with a boiling range between 185° and 210° C. The photoconductor layer is removed with a solution of 35 g of sodium metasilicate hydrate in a mixture of 140 ml of glycerol, 550 ml of ethylene glycol, 140 ml of ethanol, and 200 ml of water. The printing plate thus produced is distinguished by the particularly good hydrophilic properties of its image-free areas.

EXAMPLE 8

A solution of 6 g of a styrene/maleic anhydride copolymer with a softening point of 210° C in a mixture of 74 ml of glycol monomethyl ether and 20 ml of butyl acetate is mechanically coated onto a 100μ thick, superficially roughened aluminum foil. After evaporation of the solvent, the coated foil is charged by means of a corona, using an image-wise blanked-out aluminum foil as a stencil. The charged image areas have a negative potential of 300 volts. The charge image thus produced is then developed with a toner liquid prepared by dispersing 0.3 g of copper-II-chloride in a solution of 0.4 g of a pentaerythritol resin ester in 20 ml of an isoparaffin and diluting the resulting dispersion with 1,000 ml of an isoparaffin with a boiling range between 189° and 210° C. The toner-covered foil is converted into a printing form as described in Example 1.

EXAMPLE 9

A photoconductive material consisting of a layer of substituted vinyl oxazole and a binder on an aluminum support and produced as described in Example 2 is charged in the dark by means of a corona to a negative potential of 400 volts.

The charged foil is exposed in contact with a positive transparency as the original, the exposure time being 2 seconds for a 100 watt incandescent lamp at a distance of 65 cm. The plate is then developed with a developer liquid in which the toner particles consist of toluene-4-sulfonic acid. The developer liquid is produced by finely dispersing 0.3 g of toluene-4-sulfonic acid in a solution of 0.4 g of a pentaerythritol resin ester in 1,000 ml of an isoparaffin having a boiling range of 185° – 200° C. 3 ml of a 6% by weight solution of zirconyl linoleate are added to the developer as a charge control agent. The photoconductor layer is removed from the areas not covered by the toner in the manner described in Example 2.

EXAMPLE 10

The procedure described in Example 9 is repeated, except that the charged photoconductor layer is exposed in a re-enlargement apparatus, using a negative transparency as the original. If a 100 watt incandescent lamp is used, the exposure time is 20 seconds at stop 8 and an enlargement scale of 1 : 5. The latent image produced by exposure is developed with a dispersion of 0.3 g of boric acid in a solution of 0.4 g of pentaerythritol resin ester in 1,000 ml of an isoparaffin with a boiling range between 185° and 200° C. A positive toner image consisting of boric acid is thus produced. The toner-covered foil is converted into a printing form as described in Example 2.

It will be obvious to those skilled in the art that many modifications may be made within the scope of the present invention without departing from the spirit thereof, and the invention includes all such modifications.

What is claimed is:

1. In the process for the preparation of printing forms or metallic etchings from electrophotographic or electrographic reproduction materials composed of a support with a photoconductive organic or high-ohmic organic layer thereon, by charging and imagewise exposure, or by imagewise charging, development of the electrostatic image with a finely divided toner, fixing, and removal of the layer in the image-free areas by means of a decoating solution, the improvement which comprises developing the electrostatic image with a developer which chemically reacts at least superfically with the image areas of the photoconductive organic or high-ohmic organic layer at room temperature, thereby simultaneously effecting development and resistance to the decoating solution, or developing the electrostatic image with a developer which chemically reacts with the decoating solution and thereby deactivates it in the image areas.

2. A process according to claim 1 in which the developer reacts at least partially with a resin binder of the photoconductive or highohmic layer to form a complex compound, a chelate compound, or a salt.

3. A process according to claim 1 in which the developer reacts at least partially with the photoconductor component of the layer to form a sparingly soluble donor-acceptor complex.

4. A process according to claim 1 in which the developer reacts at least partially with a component of the decoating solution to form a salt and thereby prevents the decoating solution from acting upon the areas of the copying layer which are covered by the developer.

5. A process according to claim 1 in which the developer is composed of a high-ohmic liquid phase with a finely-divided solid phase dispersed therein.

6. A process according to claim 1 in which the developer contains at least one salt of a multi-valent metal, said salt reacting with a polymer or a copolymer containing acid groups or anhydride groups which is present in the layer as a resin binder.

7. A process according to claim 1 in which the developer comprises magnesium sulfate.

8. A process according to claim 1 in which the developer comprises potassium aluminum sulfate.

9. A process according to claim 1 in which the developer conprises copper chloride.

10. A process according to claim 1 in which the developer comprises at least one compound of the triphenyl methane dyestuff type.

11. A process according to claim 1 in which the developer comprises at least one aromatic diazonium salt.

12. A process according to claim 1 in which the developer comprises at least one substance which serves as an electron acceptor or electron donor in molecular complexes formed with the photoconductor present in the layer.

13. A process according to claim 12 in which the developer, being an electron acceptor, comprises at least one compound selected from the group consisting of tetraphenyl cyclopentadienone, benzoquinone, dicyanochloro benzoquinone, benzoanthraquinone, tetrachloroquinone, dibromosuccinic acid, tetrachlorophthalic anhydride, dinitronaphthalic anhydride and tetranitronaphthalene.

14. A process according to claim 13 in which the developer comprises tetraphenyl cyclopentadienone.

15. A process according to claim 1 in which the developer comprises calcium oxide.

16. A process according to claim 1 in which the developer comprises boric acid or toluene sulfonic acid.

17. A process according to claim 1 in which the developer additionally contains a finely-divided solid substance which renders the image areas hydrophobic.

18. A process according to claim 17 in which the substance imparting hydrophobic properties is selected from the group consisting of bitumen, waxes, and resins.

19. A process according to claim 1 in which the photoconductive or high-ohmic layer contains a resin binder which is soluble in aqueous or alcoholic solvent systems.

20. A process according to claim 19 in which the resin binders used are composed of high molecular weight substances containing groups which render them alkali-soluble.

21. A process according to claim 19 in which the resin binder is a copolymer containing anhydride groups.

22. A process according to claim 19 in which the resin binder is a styrene/maleic anhydride copolymer.

23. A process according to claim 1 including etching of the bared image-free areas of the support.

24. A process according to claim 1 in which the developer contains at least one salt of a multi-valent metal selected from the group consisting of chromium, manganese, iron, copper, and the metals of the IInd, IIIrd, and IVth main groups of the Periodic System, said salt reacting with a polymer or a copolymer containing acid groups or anhydride groups which is present in the layer as a resin binder.

* * * * *